US012416160B1

(12) United States Patent
Kenny et al.

(10) Patent No.: US 12,416,160 B1
(45) Date of Patent: Sep. 16, 2025

(54) EXTRUDED ALUMINUM CANOPY WITH HIDDEN FASTENERS

(71) Applicant: Jeffrey S. Kenny, Fort Worth, TX (US)

(72) Inventors: Jeffrey S. Kenny, Fort Worth, TX (US); Curtis Herron, Fort Worth, TX (US)

( * ) Notice: Subject to any disclaimer, the term of this patent is extended or adjusted under 35 U.S.C. 154(b) by 0 days.

(21) Appl. No.: 18/337,242

(22) Filed: Jun. 19, 2023

Related U.S. Application Data

(60) Division of application No. 17/029,859, filed on Sep. 23, 2020, now Pat. No. 11,680,412, which is a continuation-in-part of application No. 15/986,275, filed on May 22, 2018, now Pat. No. 10,907,359, which is a division of application No. 14/975,014, filed on Dec. 18, 2015, now Pat. No. 9,976,310.

(51) Int. Cl.
*E04F 10/00* (2006.01)

(52) U.S. Cl.
CPC ..... *E04F 10/005* (2013.01)

(58) Field of Classification Search
CPC ..... E04F 10/00; E04F 10/005; E04F 10/08; E04F 10/10; E04B 1/003; E04B 1/0038; E04B 1/3416; E04B 1/34; E04B 1/342; F16S 1/02; F16S 3/02; F16S 3/04; F16S 3/06; F16S 3/08; F16B 37/044; F16B 37/045
See application file for complete search history.

(56) References Cited

U.S. PATENT DOCUMENTS 1,926,609 A 9/1933 Bauschard
2,701,397 A 2/1955 Taylor
2,762,089 A 9/1956 Auble
3,084,479 A 4/1963 Struben
3,107,401 A 10/1963 Heirich
3,113,434 A * 12/1963 Phillips ..... E04F 10/08 52/95
3,286,404 A 11/1966 Harrison
3,375,029 A 3/1968 Frye et al.
3,388,510 A * 6/1968 Smith ..... E04F 10/08 D25/56

(Continued)

FOREIGN PATENT DOCUMENTS

FR 2587067 A1 3/1987

OTHER PUBLICATIONS

Halfen Flexible Bolt Connections, 2011 corresponding to U.S. Appl. No. 15/986,334.

(Continued)

*Primary Examiner* — Jessica L Laux
(74) *Attorney, Agent, or Firm* — James E. Walton

(57) ABSTRACT

A system for extrusion based hidden fastener canopies includes an extruded canopy support member, a facial member, a gutter cap member, a clip member, and a fastener. The extruded canopy support member has a facial surface. The facial member has at least one track, and the facial member is attached to the facial surface. The gutter cap member is connected to the track. The clip member includes a first and second edge, which are spaced apart by a length of material that corresponds to an attachment dimension of the facial member. The facial surface and an edge of the clip member receive the fastener. Both the clip member and the fastener are hidden from view.

8 Claims, 11 Drawing Sheets

(56) References Cited

U.S. PATENT DOCUMENTS

| | | | | |
|---|---|---|---|---|
| 3,524,289 | A * | 8/1970 | Yazejian | E04F 10/08 52/95 |
| 3,533,587 | A | 10/1970 | Vecchiarelli et al. | |
| 3,994,104 | A | 11/1976 | Gurrola | |
| 4,100,703 | A | 7/1978 | Sickler | |
| 4,261,143 | A | 4/1981 | Rizzo | |
| 5,116,161 | A | 5/1992 | Faisst | |
| 5,483,773 | A | 1/1996 | Parisien | |
| 5,564,579 | A | 10/1996 | Pynenburg et al. | |
| 8,104,527 | B1 | 1/2012 | Konda et al. | |
| 8,640,420 | B1 * | 2/2014 | Halley | E04F 10/08 52/650.1 |
| 8,683,752 | B1 | 4/2014 | Gonzalez | |
| 8,739,473 | B2 | 6/2014 | Michel et al. | |
| 9,328,516 | B2 | 5/2016 | Albert et al. | |
| 2004/0049993 | A1 | 3/2004 | Saldana | |
| 2005/0188903 | A1 | 9/2005 | Ryberg | |
| 2006/0180702 | A1 | 8/2006 | Pfeifer | |
| 2010/0126081 | A1 * | 5/2010 | Michel | E04F 10/005 52/702 |
| 2011/0302871 | A1 * | 12/2011 | Michel | E04F 10/005 52/660 |
| 2013/0140416 | A1 | 6/2013 | West et al. | |
| 2015/0052712 | A1 | 2/2015 | Markiewicz et al. | |
| 2015/0101260 | A1 | 4/2015 | Albert et al. | |
| 2015/0176631 | A1 | 6/2015 | McCarthy et al. | |
| 2016/0076254 | A1 | 3/2016 | Wiborg et al. | |

OTHER PUBLICATIONS

Mechanical behaviour of bolt-channel joining technology for aluminum structures, Fiorini et al., First published Oct. 2014 corresponding to U.S. Appl. No. 15/986,334.
Office Action dated Feb. 24, 2017 from related U.S. Appl. No. 14/975,014.
Response to Restriction Requirement dated Apr. 20, 2017 from related U.S. Appl. No. 14/975,014.
Office Action dated May 18, 2017 from related U.S. Appl. No. 14/975,014.
Amendment dated Sep. 18, 2017 from related U.S. Appl. No. 14/975,014.
Final Office Action dated Dec. 8, 2017 from related U.S. Appl. No. 14/975,014.
Amendment under 37 C.F.R. Section 1.114 from related U.S. Appl. No. 14/975,014.
Notice of Allowance dated Apr. 2, 2018 from related U.S. Appl. No. 14/975,014.
Office Action dated Oct. 28, 2019 from related U.S. Appl. No. 15/986,275.
Amendment dated Jan. 28, 2020 from related U.S. Appl. No. 15/986,275.
Interview Summary dated Jan. 30, 2020 from related U.S. Appl. No. 15/986,275.
Final Office Action dated Feb. 27, 2020 from related U.S. Appl. No. 15/986,275.
Amendment After Final dated Apr. 23, 2020 from related U.S. Appl. No. 15/986,275.
Advisory Action dated May 14, 2020 from related U.S. Appl. No. 15/986,275.
Amendment under 37 C.F.R. Section 1.114 dated May 27, 2020 from related U.S. Appl. No. 15/986,275.
Notice of Allowance dated Oct. 15, 2020 from related U.S. Appl. No. 15/986,275.
Office Action dated Oct. 28, 2019 from related U.S. Appl. No. 15/986,334.
Amendment dated Jan. 28, 2020 from related U.S. Appl. No. 15/986,334.
Interview Summary dated Jan. 30, 2020 from related U.S. Appl. No. 15/986,334.
Final Office Action dated Feb. 27, 2020 from related U.S. Appl. No. 15/986,334.
Amendment After Final dated Apr. 23, 2020 from related U.S. Appl. No. 15/986,334.
Advisory Action dated May 19, 2020 from related U.S. Appl. No. 15/986,334.
Office Action dated Aug. 13, 2020 from related U.S. Appl. No. 15/986,334.
Amendment dated Nov. 12, 2020 from related U.S. Appl. No. 15/986,334.
Final Office Action dated Mar. 17, 2021 from related U.S. Appl. No. 15/986,334.
Amendment After Final dated May 14, 2021 from related U.S. Appl. No. 15/986,334.
Advisory Action dated Jun. 11, 2021 from related U.S. Appl. No. 15/986,334.
Amendment under 37 C.F.R. Section 1.114 dated Jun. 14, 2021 from related U.S. Appl. No. 15/986,334.
Notice of Allowance dated Jun. 23, 2021 from related U.S. Appl. No. 15/986,334.
Office Action dated Mar. 23, 2022 from related U.S. Appl. No. 17/029,859.
Response to Restriction Requirement dated May 23, 2022 from related U.S. Appl. No. 17/029,859.
Office Action dated Jun. 23, 2022 from related U.S. Appl. No. 17/029,859.
Amendment dated Sep. 23, 2022 from related U.S. Appl. No. 17/029,859.
Final Office Action dated Dec. 7, 2022 from related U.S. Appl. No. 17/029,859.
Amendment After Final dated Jan. 31, 2023 from related U.S. Appl. No. 17/029,859.
Notice of allowance dated Feb. 16, 2023 from related U.S. Appl. No. 17/029,859.
Corrected Notice of Allowability dated Mar. 1, 2023 from related U.S. Appl. No. 17/029,859.
Corrected Notice of Allowability dated Mar. 13, 2023 from related U.S. Appl. No. 17/029,859.
Notice to File Corrected Application Papers dated Mar. 20, 2023 from related U.S. Appl. No. 17/029,859.
Response to Notice to File Corrected Application Papers dated Mar. 24, 2023 from related U.S. Appl. No. 17/029,859.

* cited by examiner

EXTRUDED ALUMINUM CANOPY WITH HIDDEN FASTENERS

CROSS REFERENCE TO RELATED APPLICATIONS

This application is a divisional of U.S. patent application Ser. No. 17/029,859, filed 23 Sep. 2020, titled "Extruded Aluminum Canopy With Hidden Fasteners," which is a continuation-in-part of U.S. patent application Ser. No. 15/986,275, filed 22 May 2018, titled "Extruded Aluminum Canopy With Hidden Fasteners," which issued as U.S. Pat. No. 10,907,359 on 2 Feb. 2021, which is a divisional of U.S. patent application Ser. No. 14/975,014, filed 18 Dec. 2015, titled "Extruded Aluminum Canopy With Hidden Fasteners," which issued as U.S. Pat. No. 9,976,310 on 22 May 2018, all of which are hereby incorporated by reference for all purposes as if fully set forth herein.

BACKGROUND

1. Field of the Invention

The present invention relates generally to canopies, and more specifically to a system and method for canopies that feature hidden fasteners.

2. Description of Related Art

Canopies are structures that provide shade and protection from rain. Canopies are typically affixed to the sides of buildings near doors for shelter. Canopies are also used for aesthetic purposes to decorate buildings. Conventional canopies are assembled and welded together at the shop. After welding, the canopy is sanded and then painted or finished. The canopy is then shipped to the building and hoisted up to be secured to the building. Thus conventional canopies are size limited by the ability to fabricate them and move them in one-piece to the jobsite. Additionally a large canopy is difficult to hoist due to the weight and size. Furthermore, the one piece canopy cannot be resized at the jobsite as the assembly is welded together preventing on site job adjustment. Thus, there exists significant room for improvement in the art for overcoming these and other shortcomings of conventional systems and methods for canopies attached to the side of buildings.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
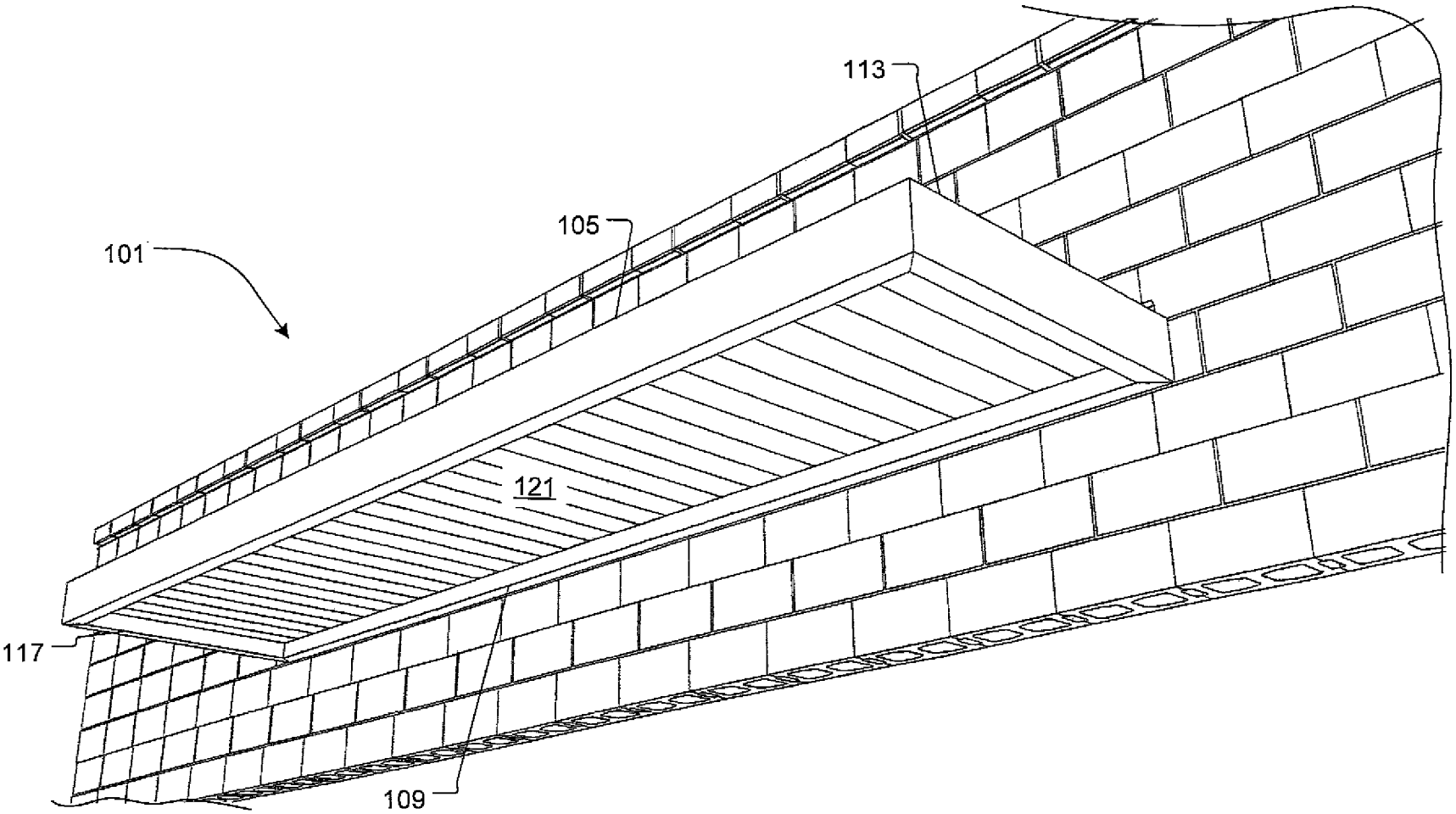
FIG. 1 is a generally upward perspective view of a canopy according to the present application.
Figure 2:
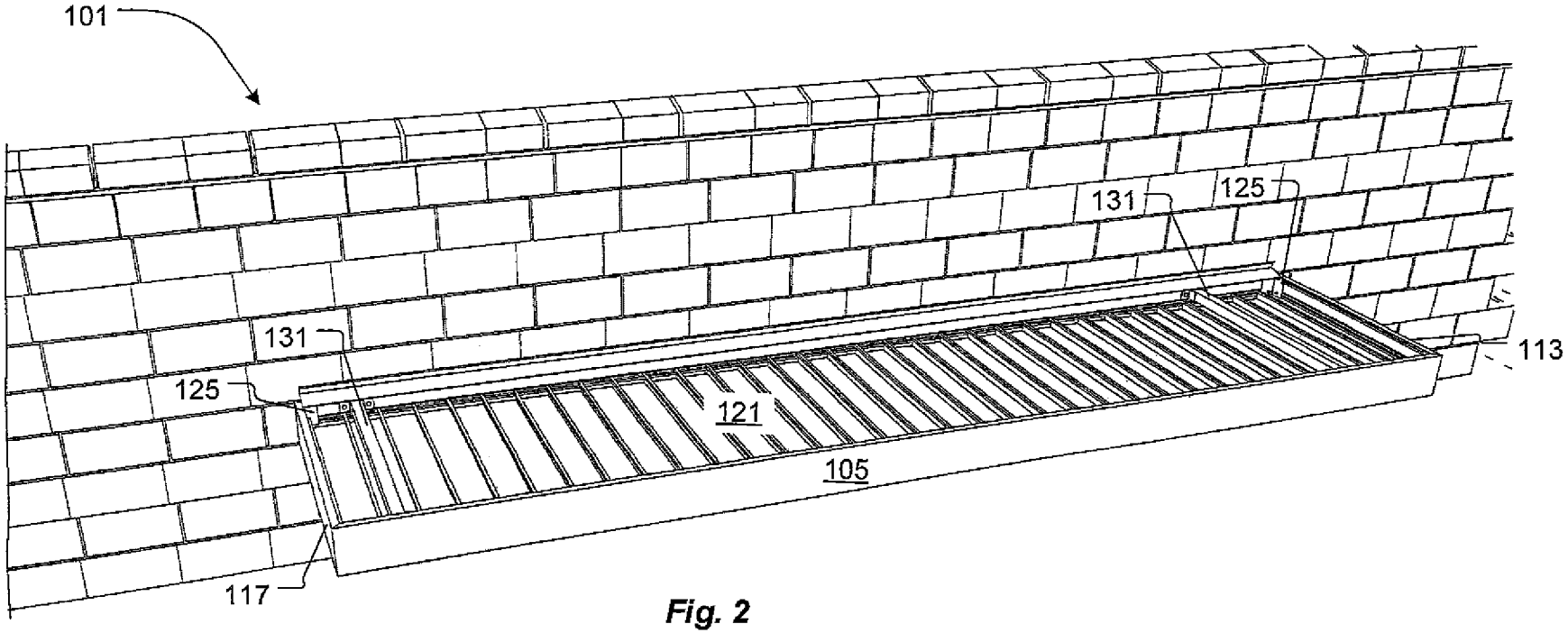
FIG. 2 is a generally downward perspective view of a canopy according to the present application.
Figure 3:
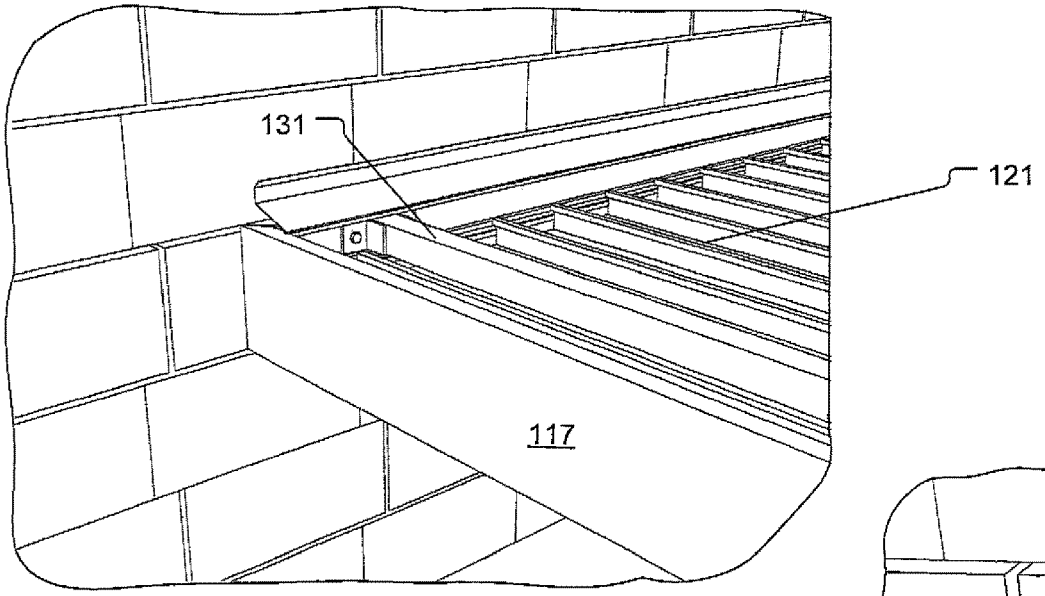
FIG. 3 is a magnified perspective view of the canopy in FIG. 2 according to the present application.
Figure 4:
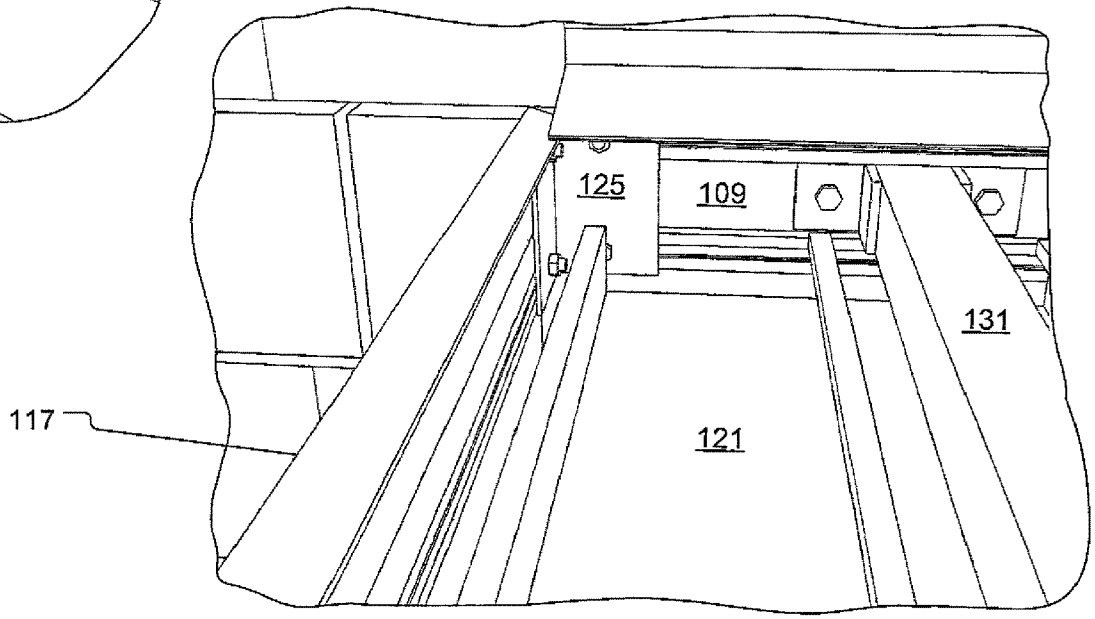
FIG. 4 is a magnified perspective view of the canopy in FIG. 2 according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the extruded aluminum canopy with hidden fasteners system and method are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1-4 in the drawings, a preferred embodiment of a canopy with hidden fasteners according to the present application is illustrated. Canopy 101 is comprised of a front member 105, a back member 109, a first end member 113, a second end member 117, and a deck panel 121. Canopy 101 is installed on the sides of buildings. First the back member 109 is fastened to the surface of the building. First end member 113 and second end member 117 are coupled to the back member by way of brackets 125. Front member 105 is coupled to the first end member 113 and second end member 117 by way of brackets 125 thereby forming a rectangular frame. Deck panel is then sized to fit the canopy, cut to length and width and then coupled to the rectangular frame. Deck panel 121 is typically sized to leave a substantial opening over the gutter portion of the extruded member. Alternatively the deck panel is sized to only leave a small gap above the gutter portion of the extruded member to act as a leaf guard. Deck panel is comprised of interlocked panels and is watertight so that rain falling on the canopy is directed to the extruded members and drained away. Furthermore, braces 131 are installed above the deck. Turnbuckles can be attached from the surface of the building to the braces 131 to further support canopy 101.

Canopy 101 can be cut to length in a shop or in at the installation site because the extruded members are shipped unassembled from the shop to the installation site. Furthermore, because the extruded members can be cut at the site before assembly the parts for the canopy can be adjusted at the site. For example, if the measured length of the canopy needed to be reduced, the back and front extruded members can be precisely cut to reduce the length of the canopy. Conventional welded canopies require a large amount of work to adjust the dimensions of the canopy. Since the canopy is assembled at the installation site, the amount of equipment to hoist the canopy up bit by bit is less than the amount of hoisting equipment needed for conventional welded canopies.

It should be apparent that the canopy 101 does not have fasteners viewable from underneath the canopy. The hidden fasteners of canopy 101 increase the aesthetic appeal of the canopy. Furthermore, the hidden fasteners require less finishing work and over time any corrosion due to a reaction between the fasteners and the extruded members is hidden from view.

Figure 5A:
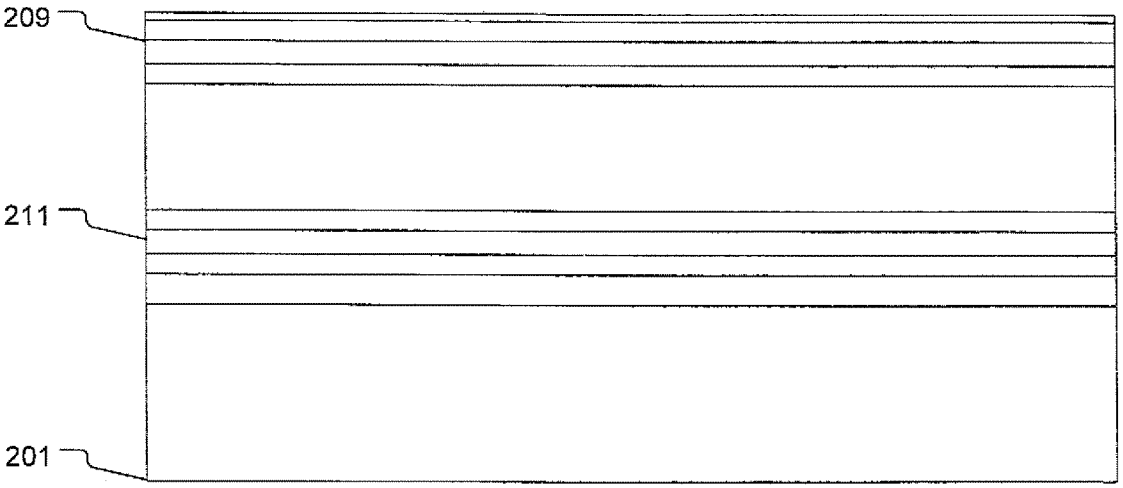
FIG. 5A is a back view of an extruded member according to the present application.
Figure 5C:
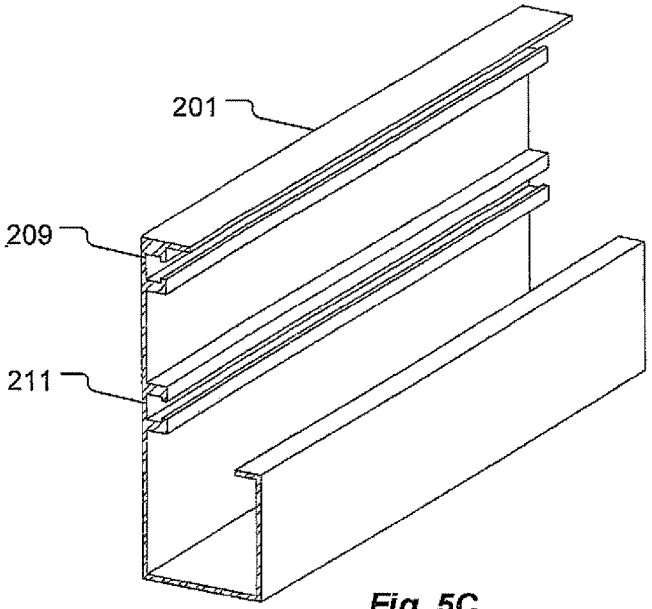
FIG. 5C is a perspective view of an extruded member according to the present application.
Figure 5B:
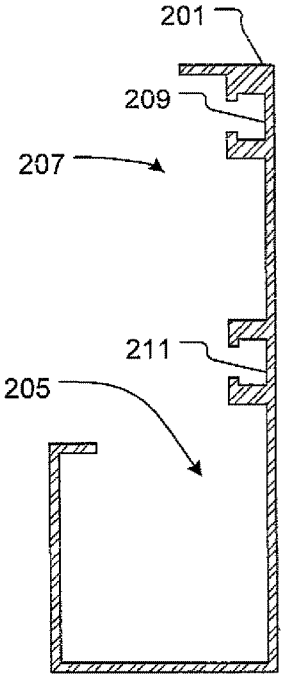
FIG. 5B is an end view of an extruded member according to the present application.

Referring now also to FIG. 5A-5B in the drawings, a preferred embodiment of an extruded member according to the present application is illustrated. Extruded member 201 is comprised of aluminum and extruded into a shape configured for use with hidden fasteners. Extruded member 201 has a gutter portion 205, a tracked portion 207, and a member length. Tracked portion 207 is comprised of at least one track 209 sized to retain a head of a bolt and prevent the bolt from twisting. The head of the bolt can be slid up and down the track however a width of the track is slightly larger than the width of the head of the bolt to prevent the bolt from rotating relative to the track. As illustrated the tracked portion further comprises of a second track 211 sized to retain a head of a bolt and prevent the bolt from twisting. It should be apparent that more tracks are contemplated by this application. Furthermore, while both tracks are illustrated outside the gutter portion 205, it should also be apparent that tracks inside the gutter portion are contemplated by this application. A benefit of locating the tracks in the tracked portion 207 is access to the tracks once the deck panel is attached. Both the first track 209 and the second track 211 run the entire length of the extruded member 201. It should be apparent that escape slots may be located in the tracks to facilitate removal and insertion of fasteners from the extruded member without being at the end of the extruded member. Escape slots are sized that the head of the fastener can be inserted or removed from the middle of the extruded member. Furthermore, there can be a plurality of escape slots located a set distance apart, for example every 1 foot.

Referring now also to FIG. 6A-6D in the drawings, a preferred embodiment of an extruded member corner assembly according to the present application is illustrated. Assembly 301 is comprised of a first extruded member 305, a second extruded member 307, a bracket 311, and a plurality of fasteners 313. The plurality of fasteners is preferably comprised of bolts and nuts. First extruded member 305 is trimmed at a forty-five degree angle at the assembled end. Second extruded member 307 is trimmed at a forty-five degree angle at the assembled end.

Figure 6A:
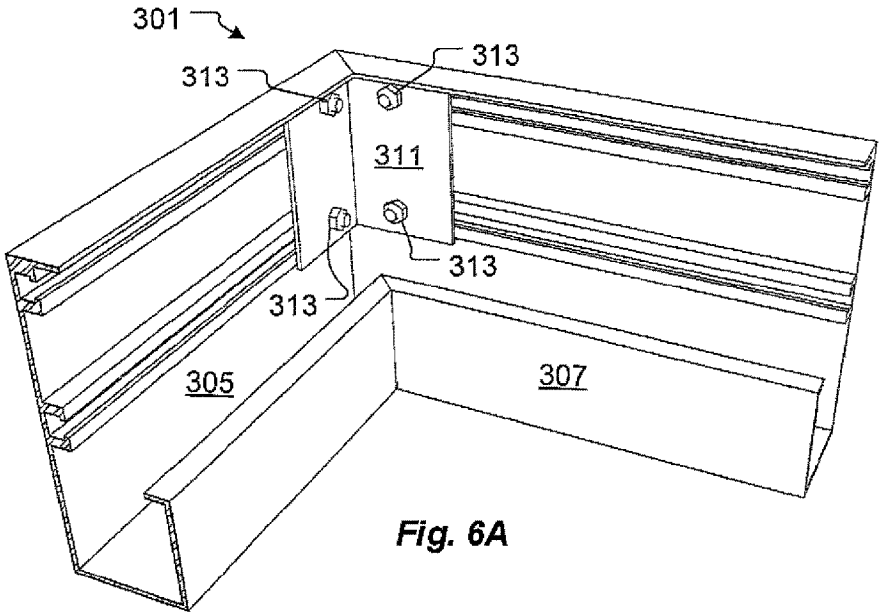
FIG. 6A is a perspective view of the back of an extruded member assembly according to the present application.
Figure 6B:
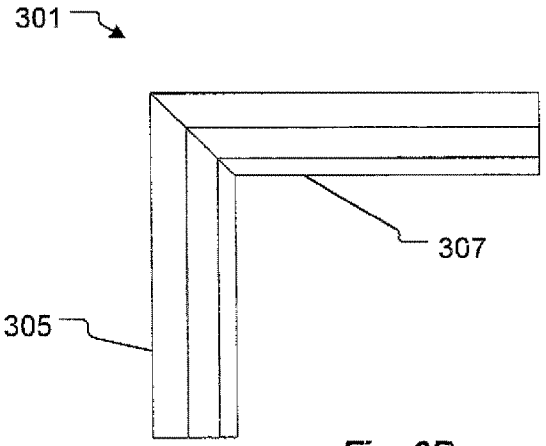
FIG. 6B is a top view of an extruded member assembly according to the present application.
Figure 6C:
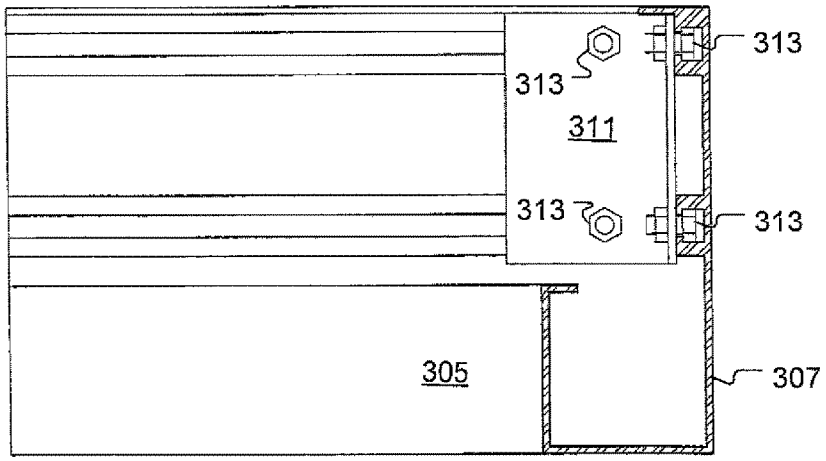
FIG. 6C is an end view of an extruded member assembly according to the present application.
Figure 6D:
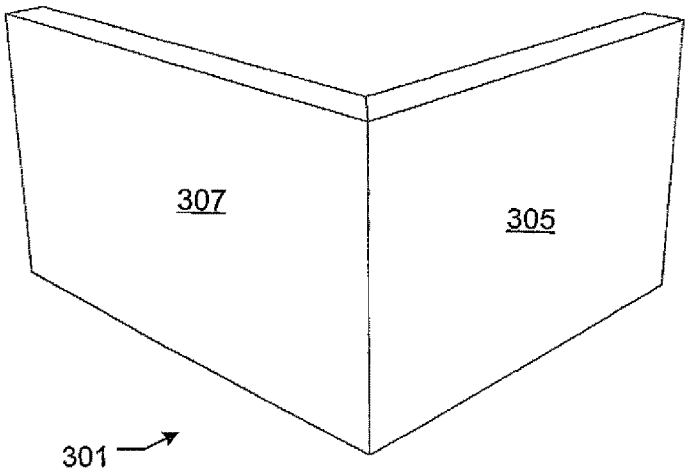
FIG. 6D is a perspective view of the front of an extruded member assembly according to the present application.

To assemble the right angle assembly 301, the head of the bolts are slid into each track of the extruded members. The bracket 311 is then coupled to the bolts and secured by nuts. A colored matched filler, such as epoxy or silicone, is applied between the extruded members to fill any small gaps. Bracket 311 as illustrated is a right angle bracket and thereby forms a right angle assembly. Other shapes and angles are possible based upon the shape of the bracket. The finished corner as shown in FIG. 6D results in a canopy without exposed fasteners viewable from underneath the assembled canopy.

Figure 7B:
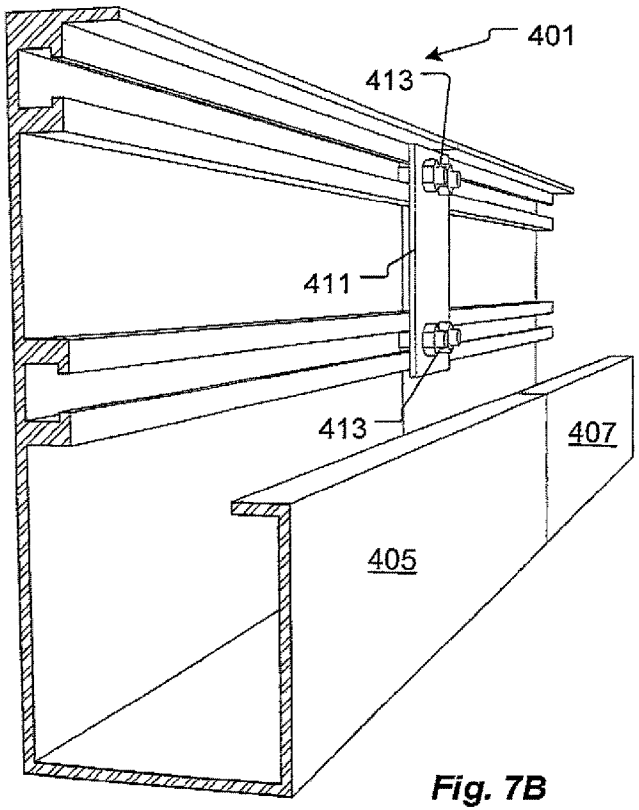
FIGS. 7A and 7B are perspective views of the back of an extruded member assembly according to the present application.
Figure 7A:
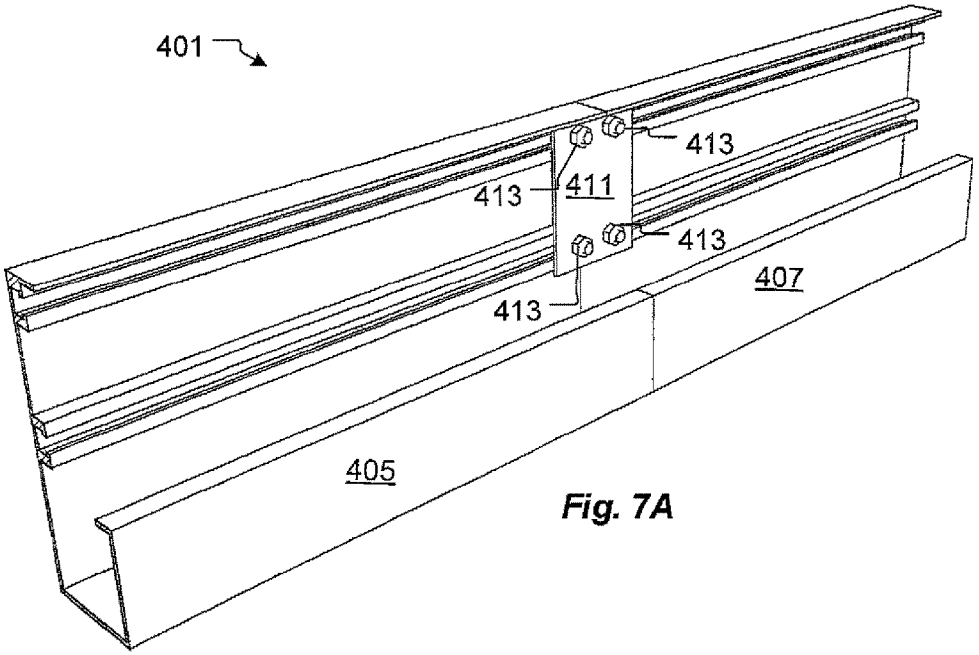

Referring now also to FIG. 7A-7B in the drawings, a preferred embodiment of an extruded member straight assembly according to the present application is illustrated. Straight assembly 401 is comprised of a first extruded member 405, a second extruded member 407, a bracket 411, and a plurality of fasteners 413. The plurality of fasteners is preferably comprised of bolts and nuts. First extruded member 405 is trimmed at a ninety degree angle at the assembled end. Second extruded member 407 is trimmed at a ninety degree angle at the assembled end.

To assemble the assembly 401, the head of the bolts are slid into each track of the extruded members. The bracket 411 is then coupled to the bolts and secured by nuts. A colored matched filler, such as epoxy or silicone, is applied between the extruded members to fill any small gaps. Bracket 411 as illustrated is a straight bracket and thereby forms a straight assembly. Other shapes and angles are possible based upon the shape of the bracket. Assembly 401 allows users to create canopies of various lengths without limitations based upon the length of the extruded members.

It should be apparent that a canopy can comprised of multiple right angle assemblies 301. Furthermore, it should be apparent that multiple right angle assemblies 301 can be joined together by straight assemblies 401 to form a canopy. Additionally, the parts of the canopy can be preassembled at a shop and shipped to the installation site. For example, two right angle assemblies 301 can be formed at a shop, shipped to the installation site, and then combined to form a canopy. Alternatively, four right angle assemblies 401 can be preassembled at the shop, shipped to the installation site, and then combined by assemblies 401 to form a canopy.

The system and method described above solves problems inherent in conventional canopies. First, conventional canopies are welded together and therefore require cutting, welding, sanding, and finishing to repair a damaged canopy. The improved system comprised of extruded members can be disassembled, damaged part replaced, and reassembled without the need to weld, sand, or refinish the canopy. Second, conventional canopies have exposed fasteners viewable from the front and underside of the canopy. The improved system hides the fasteners inside the canopy where they are less visible. Third, conventional systems are assembled and assembled at a shop and then trucked to the installation site, thereby limiting the size of canopy based at least upon the ability to move the conventional welded canopy. The improved system allows a canopy to be shipped unassembled and then assembled at the installation site. Furthermore, it is safer to hoist the canopy a piece at a time instead of a heavier completely assembled canopy.

A method for assembling a canopy having hidden fasteners; providing a first member having at least two tracks; providing a second member having at least two tracks; providing a bracket; providing a first set of fasteners;

providing a second set of fasteners; sliding the first set of fasteners into the at least two tracks of the first member; sliding the second set of fasteners into the at least two tracks of the second member; and coupling the first member to the second member with the bracket and both the first set of fasteners and the second set of fasteners. Furthermore, by sizing the at least two tracks of the first member to prevent the first set of fasteners rotating relative to the first member; and by sizing the at least two tracks of the second member to prevent the second set of fasteners rotating relative to the first member the sets of fasteners can be retained by the tracks without the using shims or additional members inside the tracks other than the bolt or fastener. Because the members are not welded together they can be dissembled and reassembled to replace defective members by providing a third member having at least two tracks; uncoupling the first member to the second member with the bracket and both the first set of fasteners and the second set of fasteners; sliding the first set of fasteners out of the at least two tracks of the first member; sliding the first set of fasteners into the at least two tracks of the third member; and coupling the third member to the second member with the bracket and both the first set of fasteners and the second set of fasteners.

Figure 8:
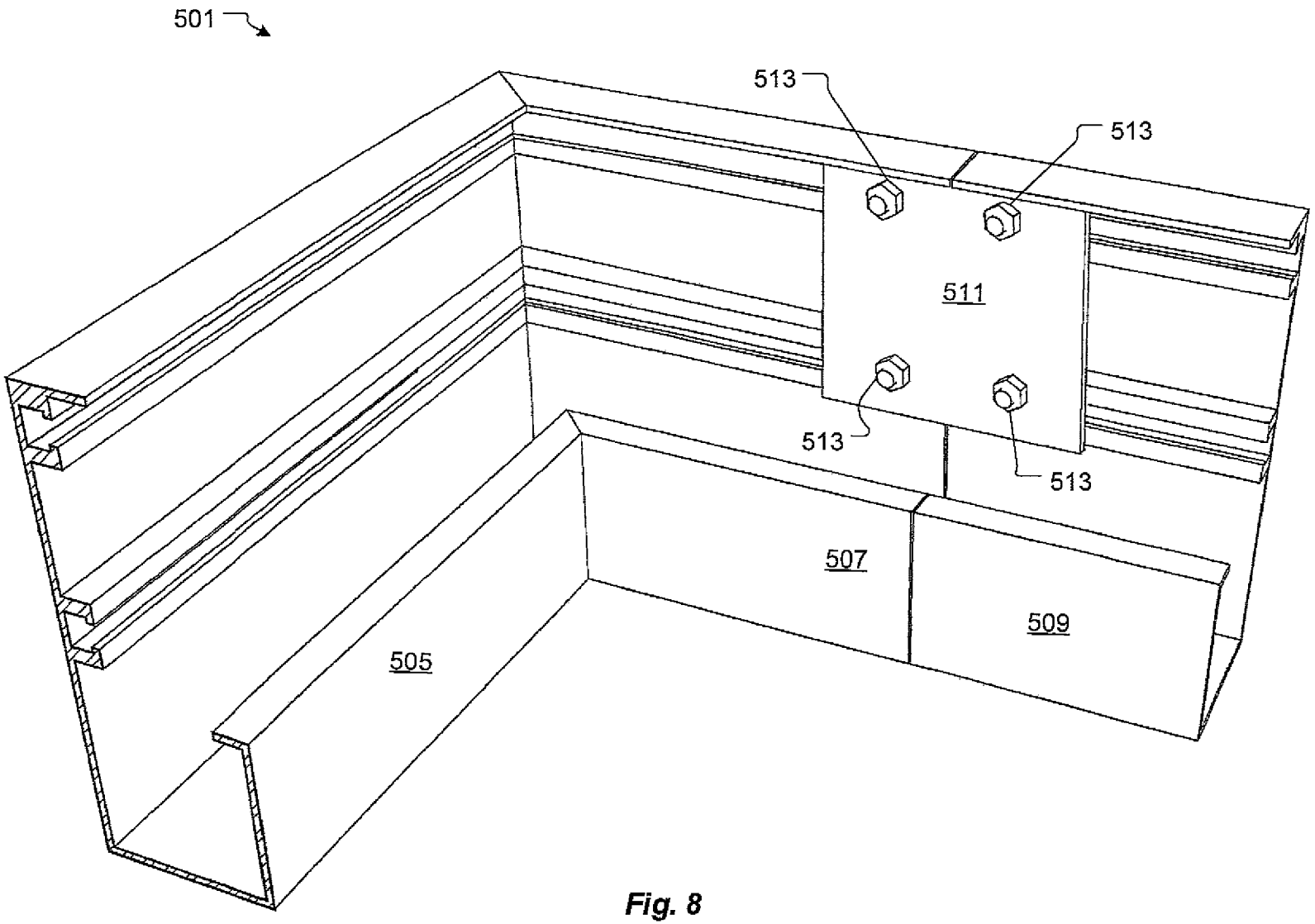
FIG. 8 is a perspective view of the back of an extruded member assembly according to the present application.

Referring now also to FIG. 8 in the drawings, an alternative embodiment of an extruded member corner assembly according to the present application is illustrated. Assembly 501 is comprised of a first extruded member 505, a second extruded member 507, a third extruded member 509, a bracket 511, and a plurality of fasteners 513. The plurality of fasteners is preferably comprised of bolts and nuts. First extruded member 505 is trimmed at a forty-five degree angle at a welded end. Second extruded member 507 is trimmed at a forty-five degree angle at a welded end. First extruded member 505 is welded to second extruded member 507 to form a 90 degree angled corner. Third extruded member 509 is coupled to the welded corner by bracket 511. This embodiment allows a user to fabricate four corners in the shop and take them out to the job site. Once there the straight extruded members can be attached with the hidden fasteners to form a canopy.

Figure 9:
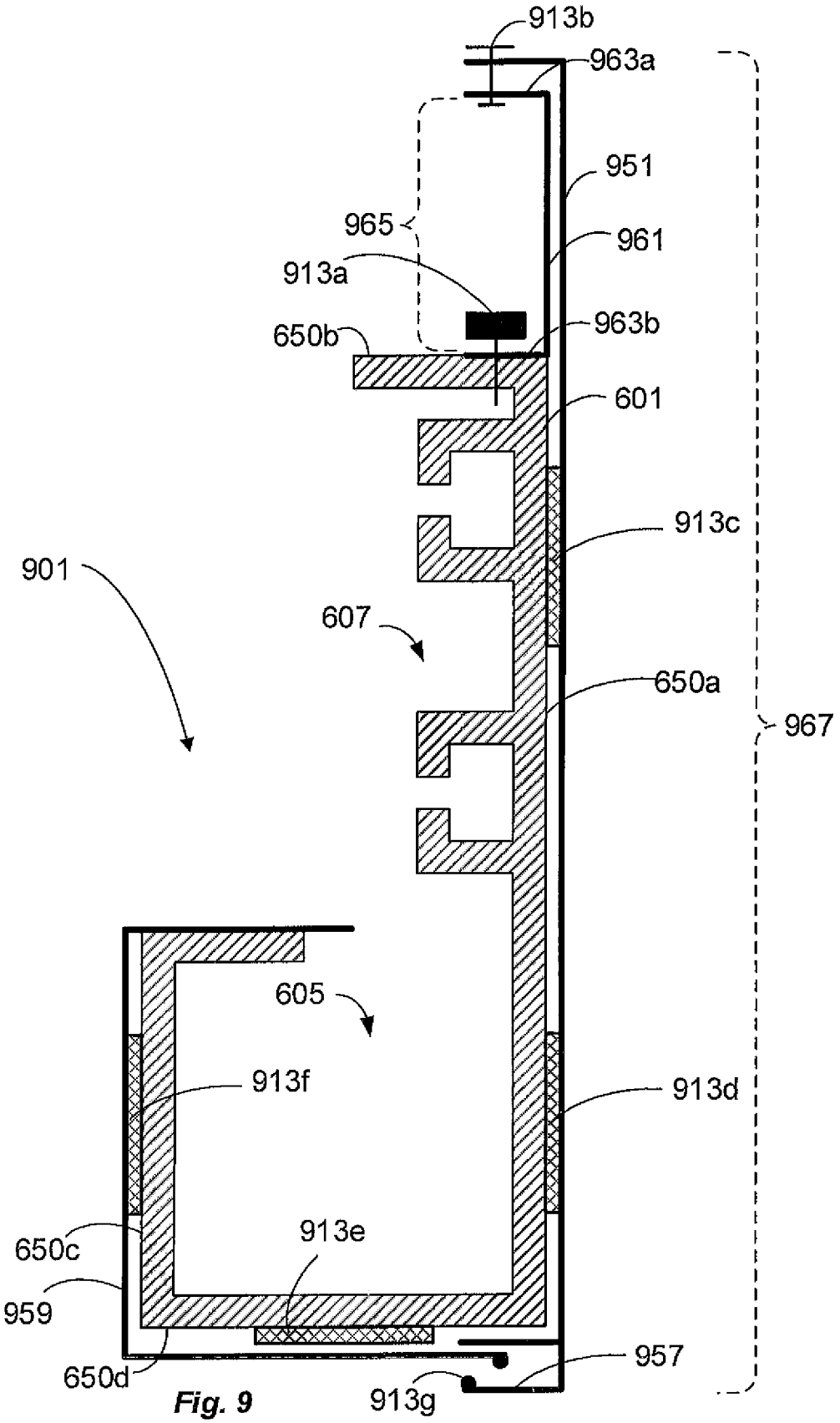
FIG. 9 is a side section view of a canopy and a multi-piece fascia system according to the present application.
Figure 10:
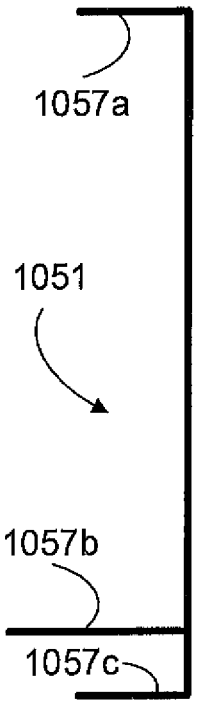
FIGS. 10-17 are side section views of alternative facial cap members according to the present application.

Referring now also to FIG. 9 in the drawings, a multi-piece fascia system 901 is illustrated. Multi-piece fascia system 901 is comprised of an extruded canopy support member 601 having a gutter portion 605, a track portion 607, and one or more facial surfaces 650*a*, 650*b*, 650*c*, 650*d* with a facial member 951, a gutter cap member 959, and a clip support member 961 attached to one or more facial surfaces 650. Multi-piece fascia system 901 is attached to extruded canopy member 601 using one or more fasteners 913*a*, 913*b*, 913*c*, 913*d*, 913*e*, 913*f*, and 913*g*. Although multi-piece fascia system 901 is depicted as attached to an extruded canopy member, other uses are contemplated by the present application. For example, multi-piece facial system 901 may be attached or integrated with a deck pan, a fence rail, a truss, an awning, or a portion thereof.

In a preferred embodiment, gutter cap 959 includes an opening or a track that fits around gutter portion 605 of extruded canopy member 601. The dimensions are such that gutter cap 959 leaves a slight airgap at least on one side (bottom) between an edge of gutter cap 959 and an edge of extruded canopy member 601. The airgap includes an adhesive strip (below).

In a preferred embodiment, clip support member 961 is a plurality of sheared extruded bracket portions evenly spaced across extruded canopy member 601. A number of brackets included in the plurality of bracket portions is dependent at least on a length of extruded canopy member 601 and a desired structural stability. Alternatively, clip support member 961 is a single, continuous extruded bracket commensurate in length with the length of extruded canopy member 601. It is noted that facial member 951 and gutter cap member 959 may also comprise a plurality of sheared portions, but are preferably continuous lengths in order to provide unitary structural and aesthetic features.

In a preferred embodiment, clip support member 961 has a first edge 963*a* and a second edge 963*b*. First and second edges 963*a*, 963*b* are spaced apart by a length of material 965, where length of material 965 corresponds to an attachment dimension 967 of facial member 951.

In a preferred embodiment, multi-piece fascia system 901 is attached to extruded canopy member 601 using a combination of adhesive and hidden fasteners. For example, one or more adhesive portions 913*c*, 913*d*, 913*e*, and 913*f* adhere multi-piece fascia system 901 to an exterior surface of extruded canopy member 601. Preferably, adhesive portions 913*c*, 913*d*, 913*e*, and 913*f* are adhesive tape portions. In other embodiments, adhesive 913*c*, 913*d*, 913*e*, and 913*f* is a continuous adhesive strip or adhesive spray adhered between extruded canopy member 601 and multi-piece fascia system 901. A screw 913*a* secures clip support member 961 to a top facial surface 650*b* of extruded canopy member 601. A rivet 913*b* secures a flange of clip support member 961 to an attachment tab of facial member 951. Both screw 913*a* and rivet 913*b* are visually imperceptible relative to the front facial surface from a front perspective and from a generally upward perspective view of a canopy incorporating the multi-piece fascia system 901. Screw 913*a* is imperceptible relative to upward and downward perspectives.

In a preferred embodiment, multi-piece fascia system 901 includes at least three bent or extruded aluminum members. Bent aluminum members are made from a flat pattern from a single unitary piece of material and may include fold or bend lines to indicate how to form the member. In other embodiments, the number of members and the type of material varies depending on expected use, weather conditions, desired appearance, and combinations thereof. For example, an extruded plastic or polymer may be used, reducing the weight of the facial system and allowing clip support member 961 to be extended, removed, or exchanged. In a preferred embodiment, adhesive is not applied between clip support member 961 and facial member 951, saving on adhesive material. In other embodiments, adhesive is applied between clip support member 961 and facial member 951.

In a preferred embodiment, the ratio of facial member 951 height to canopy extruded member 601 height is 3/2. For example, facial member 951 is one of a four-inch, six-inch, eight-inch, or 12-inch high extruded member, while canopy extruded member 601 is one of a two-and-two-thirds-inch, four-inch, six-inch, or eight-inch high extruded member. In other embodiments, the ratio increases above 3/2, and multi-piece facial system 901 incorporates a structurally reinforced clip support member 961 and/or structurally reinforced facial member 951. In yet other embodiments, the ratio decreases below 3/2, clip support member 961 becomes an optional component of the multi-piece facial system 901, and a shear and/or break feature of at least the facial member 951 is incorporated.

In a preferred embodiment, clip support member 961 is C-shaped having a thickness that is the same as the thickness of facial member 951. In other embodiments, clip support member 961 varies in thickness across its surface and/or relative to the thicknesses of the other multi-piece facial system members. In yet other embodiments, clip support member 961 includes additional folds, flutes, channels, bends, surface hardening, or combinations thereof, in order to provide additional support to facial members having large dimensions. In other embodiments, facial member 951 and the gutter cap member 959 may also have additional folds, flutes, channels, bends, varying thicknesses, surface hardening, or combinations thereof, in order to provide additional support. In a preferred embodiment, the flanges of the C-shaped clip support member 961 form a right angled track for retaining the screw 913*a* in such a way that the screw may be rotated and removed. In other embodiments, at least a top flange of the clip support member 961 is not at a right angle, but rather at an acute angle with the corresponding flange of facial member 951 also being at a corresponding acute angle.

In a preferred embodiment, facial member 951 includes a C- or inverted F-shaped track 957. The C- or inverted F-shaped track 957 overlaps and integrates with the gutter cap member 959. The overlap is sufficiently sized to accommodate any protruding fasteners the multi-piece facial system 901 is intended to cover up. For example, if a ¼ inch head of a bolt protrudes from the face of a canopy, at least the outermost flange (bottom flange in FIG. 9) of the track 957 is more than ¼ inches in length, such that the underlying canopy structure is still facially covered by the overlap of facial member 951 integrated with the gutter cap member 959. Additional factors that determine the length of the flange of the track 957 and the corresponding air gap size include, but are not limited to, whether facial member 951 is flexible or rigid, a location of the fasteners to be covered up on the facial surface of the canopy, an amount of material used to form facial member 951, and a desired aesthetic appearance created by the overlapping feature of track 957. In at least one embodiment, track 957 includes a ridge 913*g* and gutter cap 959 includes a corresponding ridge to provide slight lateral support and prevent an unintentional separation of facial member 951 and the gutter cap 959.

In a preferred embodiment, the gutter cap 959 includes at least two right angles, sized to encase, fit over, snap onto, clip to, or removably attach with the gutter portion 605 of extruded canopy member 601. The adhesive 913*e* and/or ridge 913*g* prevents unwanted removal of gutter cap 959 from gutter portion 605.

In an alternative embodiment, multi-piece fascia system 901 is a single, unitary cap member (not shown), which includes an attachment tab to connect to an edge of the clip member and a flange to snap onto a facial surface (e.g., surface 650*c*) of a gutter portion of a canopy support member. The single, unitary cap member connects the facial member, the clip support member, and the gutter cap member as a single, unitary structure (not shown) that is either bent or extruded to take its form. The fastener, together with the single unitary cap structure, comprises two components of an alternative multi-piece facial system.

Referring now to FIGS. 10-17 in the drawings, alternative embodiments of section views of facial members are depicted. For example, referring now to FIG. 10, a facial member 1051 includes a first track member 1057*a*, second track member 1057*b*, and a third track member 1057*c*. Preferably, at least one of the track members 1057 is formed as an attachment tab, meaning it receives a fastener to connect it with a flange or tab of gutter cap 959 or clip support member 961. In some embodiments, two or all of the track members 1057 are formed as attachment tabs. Track members 1057*a* and 1057*c* are substantially equal in the length of the side comprising the track member, while track member 1057*b* has a greater length.

Figure 11:
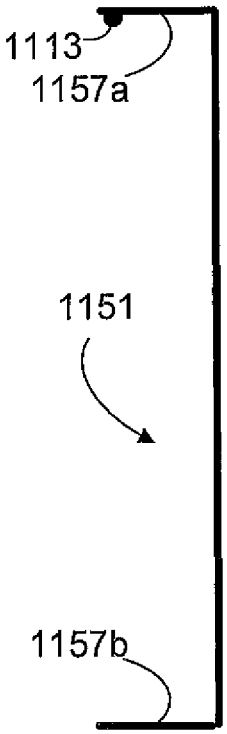

Referring now to FIG. 11, facial member 1151 includes first track member 1157*a* and second track member 1157*b*. First track member 1157*a* includes a ridge element 1113. Alternatively, track member 1157*b* or both track members include ridge element 1113.

Figure 12:
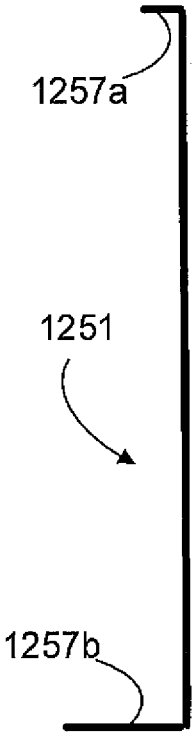

Referring now to FIG. 12, facial member 1251 includes track members 1257*a* and 1257*b* that are substantially different in length. For example, track member 1257*a* is less than or equal to half the length of track member 1257*b*. Track members 1257*a* and 1257*b* are separated by a length of material that is greater than the lengths of one or both of track members 1257*a* and 1257*b*.

Figure 13:
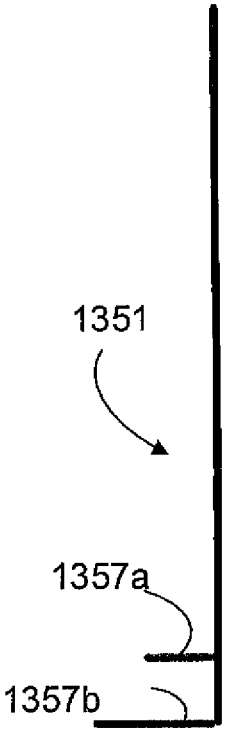

Referring now to FIG. 13 in the drawings, track members 1357*a* and 1357*b* are separated by a length of material that is less than the length of one or both of the track members, and are also connected to a length of material that is greater than or equal to a facial dimension of an extruded canopy support member, such as canopy support member 601.

Figure 14:
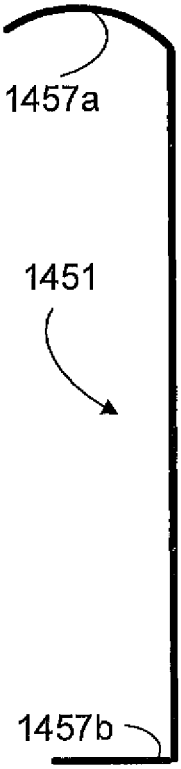

Referring now to FIG. 14 in the drawings, facial member 1451 includes a first curved track member 1457*a* and a second linear track member 1457*b*. Alternatively, 1457*b* may be curved and 1457*a* linear, or both are curved, relying on the curvature of at least one of the track members to retain the facial member onto a facial surface of the extruded canopy support member.

Figure 15:
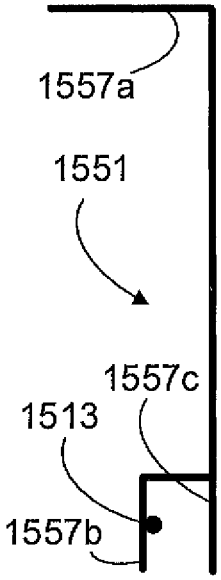

Referring now to FIG. 15 in the drawings, facial member 1551 includes first track member 1557*a*, and second and third oppositely oriented track members 1557*b* and 1557*c*. First track member 1557*a* is connected to second and third track members 1557*b*, 1557*c* by a length of material that is less than or equal to a facial dimension of a facial surface of an extruded canopy support member, such as canopy support member 601. This type of facial member is used together with a gutter cap member that overlaps portions of the same facial surface as facial member 1551 to make up for any surface not covered by facial member 1551. Facial member 1551 may also optionally include a ridge 1513.

Figure 16:
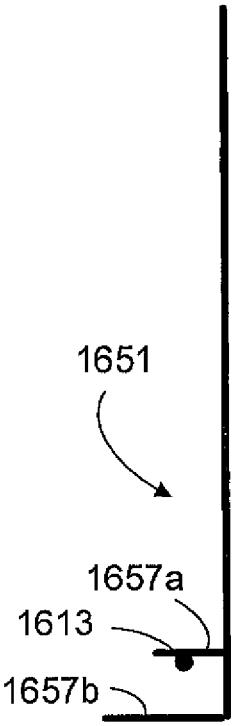

Referring now to FIG. 16 in the drawings, facial member 1651 is shaped similar to facial member 1351, except that facial member 1651 includes one or more additional structural reinforcing features and/or fastener elements. For example, first track member 1657*a* includes ridge 1613 that fits with another ridge of a gutter cap flange. In some embodiments, the structural reinforcing and/or fastening feature includes a fold, a bend, a groove, an extra layer of material, or other similar features. Alternatively, second track member 1657*b* includes the structural reinforcing or fastening feature.

Figure 17:
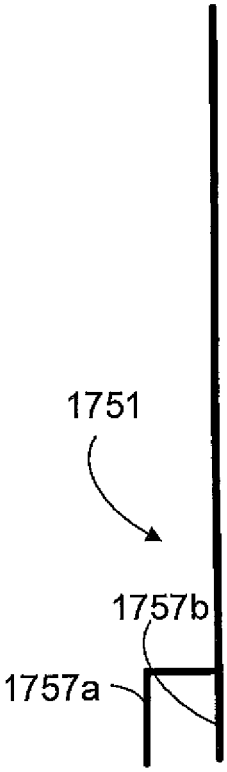
Figure 18:
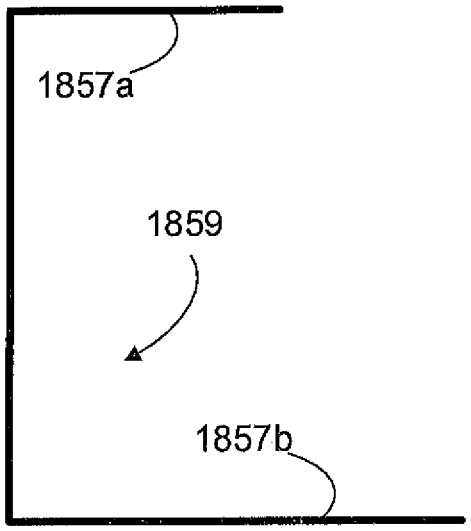
FIGS. 18-23 are side section views of alternative gutter cap members according to the present application.

Referring now to FIG. 17 in the drawings, facial member 1751 is shaped similar to facial member 1551, except that there is no latitudinal track member connected to first track member 1757*a* and second track member 1757*b*. Additionally, the track members 1757*a*, 1757*b* are connected to a length of material that is greater than or equal to a facial dimension of the facial surface of the extruded canopy support member, such as canopy support member 601.

Referring now to FIGS. 18-22 in the drawings, section views of alternative embodiments of gutter cap members are depicted. For example, referring now to FIG. 18, gutter cap member 1859 includes first flange 1857*a* and second flange 1857*b* connected by a length of material that is commensurate in length (e.g., greater than or equal to) with a facial dimension of a facial surface of a gutter potion of an extruded canopy support member, such as facial surface 650*c* of gutter portion 605. It is important to note that a side length of first flange 1857*a* may be shortened, such that all that remains of the flange is a gripping lip surface that is about 0.1-0.3 inches in length. Preferably, an end of second flange 1857*b* connects to or is seated within one or more track members of a facial member, such as facial member 951. Preferably, at least one flange of the gutter cap member is configured as an attachment tab.

Figure 19:
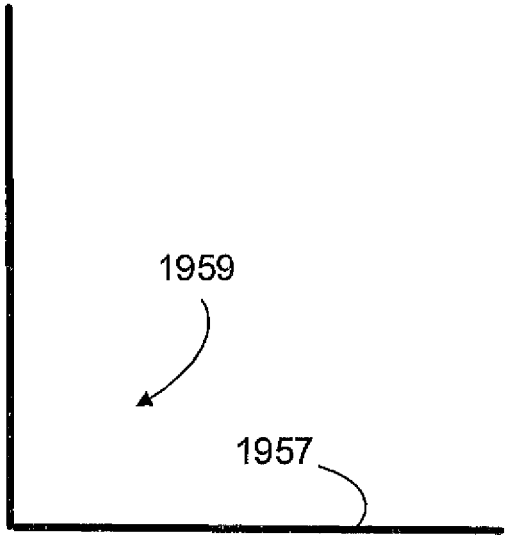

Referring now to FIG. 19 in the drawings, gutter cap member 1959 includes a single flange 1957 connected to a length of material that is greater than or equal to a facial dimension of a facial surface of a gutter portion of an extruded canopy support member, such as facial surface 650*c* of gutter portion 605. Although not depicted, flange, the length of material, or both may include structural reinforcement features and/or fastening features.

Figure 20:
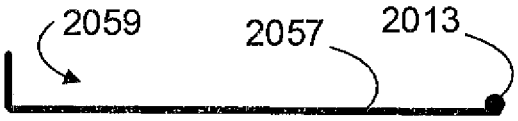

Referring now to FIG. 20 in the drawings, gutter cap member 2059 includes a single flange 2057. Flange 2057 is connected to a length of material that is less than or equal to a facial dimension of a facial surface of a gutter portion of an extruded canopy support member, such as facial surface 650*c* of gutter portion 605. Flange 2057 includes ridge 2013, or another structural reinforcing or attachment feature.

Figure 21:
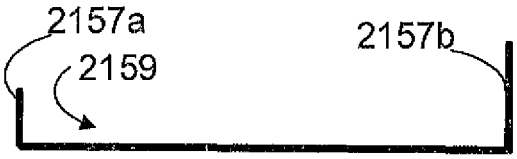

Referring now to FIG. 21 in the drawings, gutter cap member 2159 includes first flange 2157*a* and second flange 2157*b* connected to a length of material that is greater than or equal to a facial dimension of a facial surface of a gutter portion of an extruded canopy support member, such as facial surface 650*d* of gutter portion 605.

Figure 22:
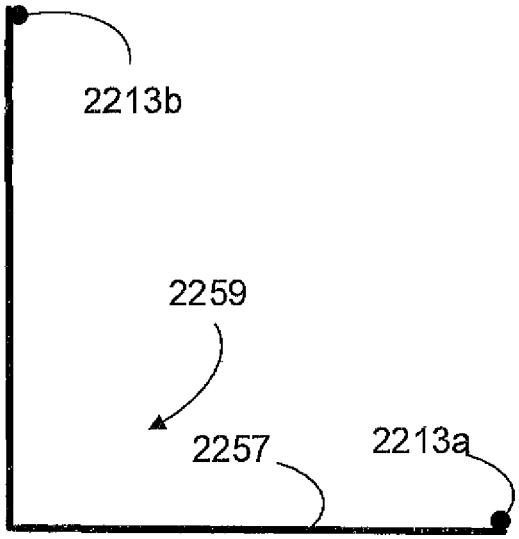

Referring now to FIG. 22 in the drawings, gutter cap member 2259 having a single flange 2257 is depicted. Single flange is connected to a length of material that is greater than a facial dimension of a facial surface of a gutter portion of an extruded canopy support member, such as facial surface 650*c* of gutter portion 605. Flange 2257 and the length of material include ridges 2213*a*, 2213*b*, or similar structural reinforcing and/or attachment features.

Figure 23:
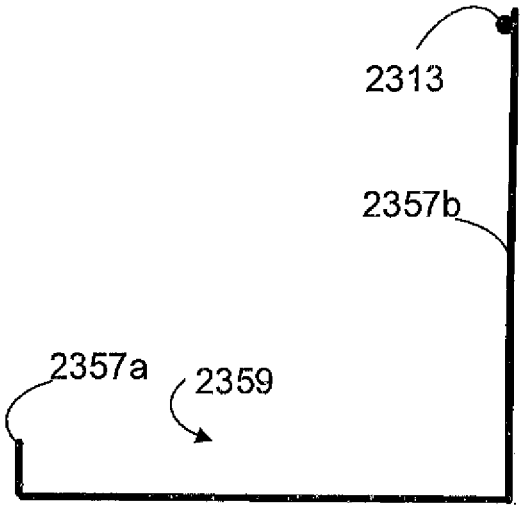

Referring now to FIG. 23 in the drawings, gutter cap member 2359 includes first flange 2357*a* and second flange 2357*b* connected to a length of material that is greater than or equal to a facial dimension of a facial surface of a gutter portion of an extruded canopy support member, such as facial surface 650*d* of gutter portion 605. Preferably, the length of material is greater than the facial dimension to provide air gaps and adhesive between the gutter cap member and the gutter cap portion 605. Preferably, flange 2357*b* covers a portion of facial surface 650*a* and connects to a track member of a facial member, such as facial member 1551. Flange 2357*b* includes ridge 2313, or another structural reinforcing or attachment feature, which preferably interlocks with ridge 1557*b*.

Figure 24:
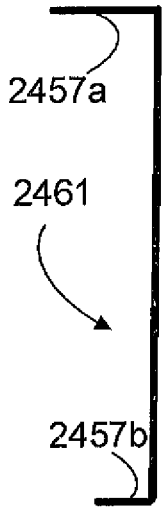
FIGS. 24-26 are side section views of alternative clip support members according to the present application.
Figure 25:
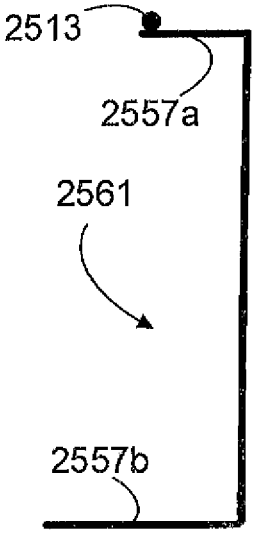
Figure 26:
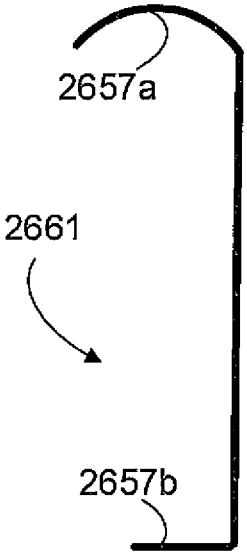

Referring now to FIGS. 24-26 in the drawings, section views of alternative embodiments of clip support members are depicted. For example, referring now to FIG. 24, clip support member 2461 includes first edge 2457*a* and second edge 2457*b* connected by a length of material, such as length 965 (FIG. 9), that is above a facial surface of a track potion of an extruded canopy support member, such as facial surface 650*a* of track portion 607. It is important to note that a side length of first edge 2457*a* may be shortened, such that all that remains of the attachment tab is a lip surface that is about 0.01-0.1 inches in length. Preferably, first edge 2457*a* is greater than or equal to a width dimension (e.g., diameter) of a rivet, such that a rivet may be received in the attachment tab. Second edge 2457*b* connects to or is seated adjacent or on top of a facial surface of the extruded canopy support member, such as facial surface 650*b*. Preferably, the clip members depicted in FIGS. 24-26 are formed by extrusion. Alternatively, they are formed by folding or bending sheet metal. Preferably, an attachment dimension 967 of a facial member depends on length of material 965 (FIG. 9), meaning that facial member may retrofit or attach to any canopy support or a deck panel of any dimension due to the structural support provided by the clip member and its length of material.

Referring now to FIG. 25, clip support member 2561 includes edge 2557*a* and second edge 2557*b* connected by a length of material that is above a facial surface of a track potion of an extruded canopy support member, such as facial surface 650*a* of track portion 607. It is important to note that a side length of second edge 2557*b* may be lengthened, such that greater than 50% of facial surface 650*b* is covered by edge 2557*b*. First edge 2557*a* includes a ridge 2513, or structural attachment feature to interlock or interface with a track member of a facial member, such as ridge 1113 of facial member 1151.

Referring now to FIG. 26 in the drawings, clip support member 2661 includes a first curved edge 2657*a* and a second linear edge 2657*b*. Alternatively, 2657*b* may be curved and 2657*a* linear, or both are curved, relying on the curvature of at least one of the edge to retain the track members of a facial member. For example, curved edge 2657*a* may interface with curved track member 1451*a* of facial member 1451. Preferably, a length of second edge 2657*b* is greater than or equal to a diameter of a screw head, such that a screw or a similar fastener is received into second edge 2657*b*.

Figure 27:
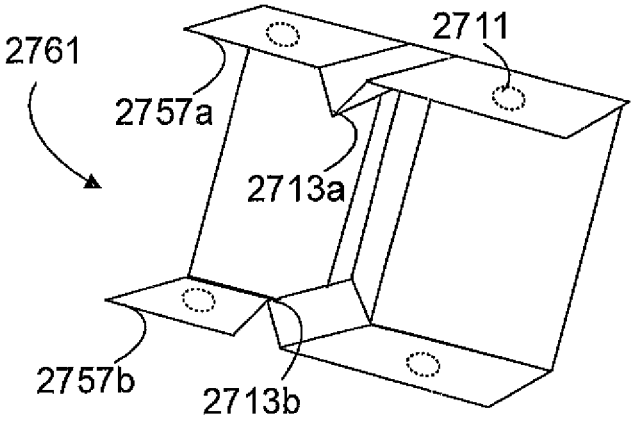
FIG. 27 is a perspective view of an alternative embodiment of a clip support member according to the present application.

Referring now to FIG. 27 in the drawings, a perspective view of an alternative embodiment of a clip support member 2761 is depicted. Clip support member 2761 includes first edge 2757*a* and second edge 2757*b*, first ridge member 2713*a*, and second ridge member 2713*b*. Fold lines separate and differentiate first and second ridge members 2713*a* and 2713*b*. Preferably, clip support member 2761 is formed from folding or bending aluminum sheet metal, and is one of multiple clip support members that are positioned lengthwise along a canopy support member. Clip support member 2761 optionally includes multiple openings or slots 2711 for receiving a fastener, such as screw 913*a* or rivet 913*b*.

A method of assembling a canopy having a multi-piece fascia system includes assembling the canopy using extruded canopy members, as discussed above. The multi-piece fascia system is formed according to the dimensions of the assembled canopy. The formation of the multi-piece fascia system includes coloring, applying indicia or graphics, bending (if necessary), and/or obtaining specified unconventional member lengths. The coloring of the multi-piece fascia system can include, but is not limited to, painting, dying, extrusion coating, and/or mill or mechanical finishing. Adhesive strip is applied to one or more exterior facial surfaces of the assembled canopy, or to an interior surface of the multi-piece facial system. The facial system is attached, having its interior surface abutting the adhesive strip(s) and portions of the exterior facial surface of the canopy. In a preferred embodiment, the adhesive is a tape. In other embodiments, the adhesive is an epoxy. A solvent, such as acetone, may be used to clean surfaces before applying adhesive.

The multi-piece facial system fasteners are secured, providing additional support from the clip support member and thereby enabling relatively large facial dimensions. In a preferred embodiment, the attachment of the clip support member and securing of fasteners is before adhesive is applied. In other embodiments, the attachment of the clip support member and securing of the facial system fasteners occurs after adhesive is applied. Due to the lightweight, stable materials used, assembly can occur at ground level, and the canopy hoisted into position with the multi-piece facial system attached. However, in a preferred embodiment, the multi-piece facial system is attached piece-wise after the canopy is assembled piece-wise onto an exterior wall of a building.

The system and method described above solves problems inherent in conventional canopies, canopy coatings, and canopy finishes. First, conventional canopies use corrosive material, are painted, or otherwise finished to avoid corrosion. The improved system comprised of pre-finished multi-piece facial members can be disassembled, damaged part replaced, and reassembled without the need to coat, finish, weld, sand, or refinish the canopy. Second, conventional canopies have exposed fasteners viewable from the front and underside of the canopy. The improved system hides the fasteners inside the canopy where they are less visible. Third, pre-existing canopies may be retrofitted with the multi-piece facial system to obtain the similar advantage of having seams and fasteners hidden by attachment of the multi-piece facial system without removing the pre-existing canopy from the wall. Fourth, conventional systems do not include gutter channeling, and if they do, the gutters require coating and/or finishing. The improved system provides gutter channeling features that do not require coating and/or finishing. Fifth, conventional canopies require repainting, refinishing, or removing the canopy to change the color and appearance. The improved multi-piece facial system enables changes to appearance and color without repainting, refinishing, or removing canopies. Sixth, auxiliary and cosmetic components of conventional canopies are welded into place, requiring finishing after these components are attached to the canopy. The improved facial system is secured to the canopy without requiring welding. Because welding is not required, additional finishing options, such as the use of polymers, plastics, and electronics are made available. Seventh, conventional systems are limited to customary lengths, such as 10-foot sections. In the improved system, continuous lengths of 15-, 20-, or 30-foot sections, or more, are made available.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A facial system for extrusion based hidden fastener canopies, comprising:

an extruded canopy support member, having:

at least one outward facing facial surface; and a gutter member;

a facial member having at least one track, the facial member attached to the at least one outward facing facial surface of the extruded canopy support member;

an external gutter cap member connected to the at least one track;

a clip member, having:

a first edge; and a second edge; and a fastener;

wherein the first edge and the second edge of the clip member are spaced apart by a length of material, the length of material corresponding to an attachment dimension of the facial member;

wherein the clip member is connected to the at least one outward facing facial surface using the fastener;

wherein the clip member and the fastener are hidden from view;

wherein the external gutter cap member encloses the gutter member; and wherein a longitudinal length of the facial member runs along a plane parallel with the extruded canopy support member, such that the longitudinal length of the facial member extends along and wraps around a longitudinal length of the extruded canopy support member.

2. The system according to claim 1, wherein one of the gutter member and the facial member further comprises:

an attachment edge.

3. The system according to claim 1, wherein the external gutter cap member is separable from the facial member.

4. The system according to claim 1, wherein the at least one outward facing facial surface of the extruded canopy support member is one of a plurality of outward facing facial surfaces of the extruded canopy support member.

5. The system according to claim 4, wherein the fastener is one of a plurality of fasteners.

6. The system according to claim 5, wherein each outward facing facial surface of the plurality of outward facing facial surfaces receives a fastener of the plurality of fasteners.

7. The system according to claim 5, wherein a fastener of the plurality of fasteners comprises an adhesive strip.

8. The system according to claim 7, wherein more than one of the fasteners of the plurality of fasteners comprises discrete adhesive strip segments.

* * * * *